United States Patent [19]

Petter et al.

[11] Patent Number: 4,659,251

[45] Date of Patent: Apr. 21, 1987

[54] LIQUID SPILL CONTAINER AND METHOD OF MAKING AND INSTALLING SAME

[75] Inventors: William J. Petter; Glenn E. Moore, both of Cincinnati, Ohio; Jack A. McMath, Ft. Thomas, Ky.; Eugene B. Pemberton, Fairfield, Ohio

[73] Assignee: Dover Corporation, New York, N.Y.

[21] Appl. No.: 778,699

[22] Filed: Sep. 23, 1985

[51] Int. Cl.[4] ..... B65B 3/06

[52] U.S. Cl. ..... 405/52; 405/36; 141/86; 137/312; 52/20

[58] Field of Search ..... 285/225, 224, 226, 229, 285/200; 405/36, 52; 137/312, 313, 363, 364; 141/86, 89; 52/20, 573; 403/376, 291, 332

[56] References Cited

U.S. PATENT DOCUMENTS

| | | | |
|---|---|---|---|
| 2,644,475 | 7/1953 | Morton | 403/332 X |
| 2,828,762 | 4/1958 | Swank | 52/20 |
| 3,092,962 | 6/1963 | Wood | 403/376 X |
| 3,374,014 | 3/1968 | Kull et al. | 403/332 |
| 3,820,829 | 6/1974 | Hasselbacher et al. | 285/226 |
| 4,038,789 | 8/1977 | Axgärde et al. | 52/20 |
| 4,278,115 | 7/1981 | Briles et al. | 141/86 |
| 4,457,349 | 7/1984 | Vazin | 141/86 |
| 4,475,845 | 10/1984 | Odill et al. | 52/20 X |
| 4,501,305 | 2/1985 | Zola et al. | 141/86 |
| 4,520,852 | 6/1985 | Klein | 141/86 |

OTHER PUBLICATIONS

Catalog 20 of OPW Division of Dover Corporation Bearing a Copyright Notice having the date 1965.

*Primary Examiner*—Cornelius J. Husar
*Assistant Examiner*—Joseph A. Fischetti
*Attorney, Agent, or Firm*—Kinney & Schenk

[57] ABSTRACT

A liquid spill container and method of making and installing the same are provided wherein such container has a side wall comprised of at least two separate portions which are detachably fastened together. One of the portions defines the sole structure of the container which is adapted to be embedded in a fixed manner in an associated substrate to provide the sole support for the container in such substrate and the other of the portions being detachable from the one portion with the one portion embedded in the substrate to enable replacement of such other portion.

26 Claims, 11 Drawing Figures

LIQUID SPILL CONTAINER AND METHOD OF MAKING AND INSTALLING SAME

BACKGROUND OF THE INVENTION

1. Field of the Invention

This invention relates to a new liquid spill container, method of making same, and method of installing such spill container in position in its intended application.

2. Description of Prior Art

It is known in the art to provide a so-called manhole or fill box for use in association with a vertical fill pipe for a tank disposed therebeneath and devices of this type are identified as OPW 122 and OPW 126-AB in catalog 20 of OPW Division of Dover Corporation, bearing a copyright notice having the date 1965.

It is also known in the art to provide a liquid spill container adapted for use at the inlet of a substantially vertical fill pipe for a storage tank with the container comprising a bottom wall, side wall means extending upwardly from the bottom wall and adapted to be embedded in a fixed manner in a supporting substrate for the side wall means and container, a cover for the container, an opening in the bottom wall for receiving the fill pipe therethrough, and seal means providing a fluid seal between the bottom wall and fill pipe while allowing relative movement therebetween along a vertical axis and as disclosed in U.S. Pat. No. 4,278,115 to Briles et al.

SUMMARY OF THE INVENTION

It is one feature of this invention to provide a new liquid spill container for use at the inlet of a substantially vertical fill pipe for a storage tank wherein such container comprises side wall means comprised of at least two separate portions having means detachably fastening the two portions together.

For example, one embodiment of this invention provides such a container comprising a bottom wall, side wall means extending upwardly from the bottom wall and adapted to be embedded in a fixed manner in a supporting substrate for said side wall means and container, a cover for said container, an opening in said bottom wall for receiving said fill pipe therethrough, and seal means providing a fluid seal between said bottom wall and fill pipe while allowing relative movement therebetween along a vertical axis. Further, the side wall means comprises at least two separate portions having means detachably fastening said portions together, one of said portions being the sole means adapted to be embedded in said fixed manner in said substrate to provide the sole support for said container in said substrate and the other of said portions being detachable from said one portion with said one portion embedded in said substrate through the use of said means detachably fastening to enable replacement of said other portion.

Accordingly, it is an object of this invention to provide a new liquid spill container of the character mentioned.

Another object of this invention is to provide a new method of making a spill container of the character mentioned.

Another object of this invention is to provide a new method of installing such a liquid spill container of the character mentioned in an associated substrate therefor.

Other features, objects, uses, and advantages of this invention will be apparent from a reading of this description which proceeds with reference to the accompanying drawings forming a part thereof.

BRIEF DESCRIPTION OF THE DRAWINGS

The accompanying drawings show present preferred embodiments of this invention, in which.

DETAILED DESCRIPTION

Figure 1:
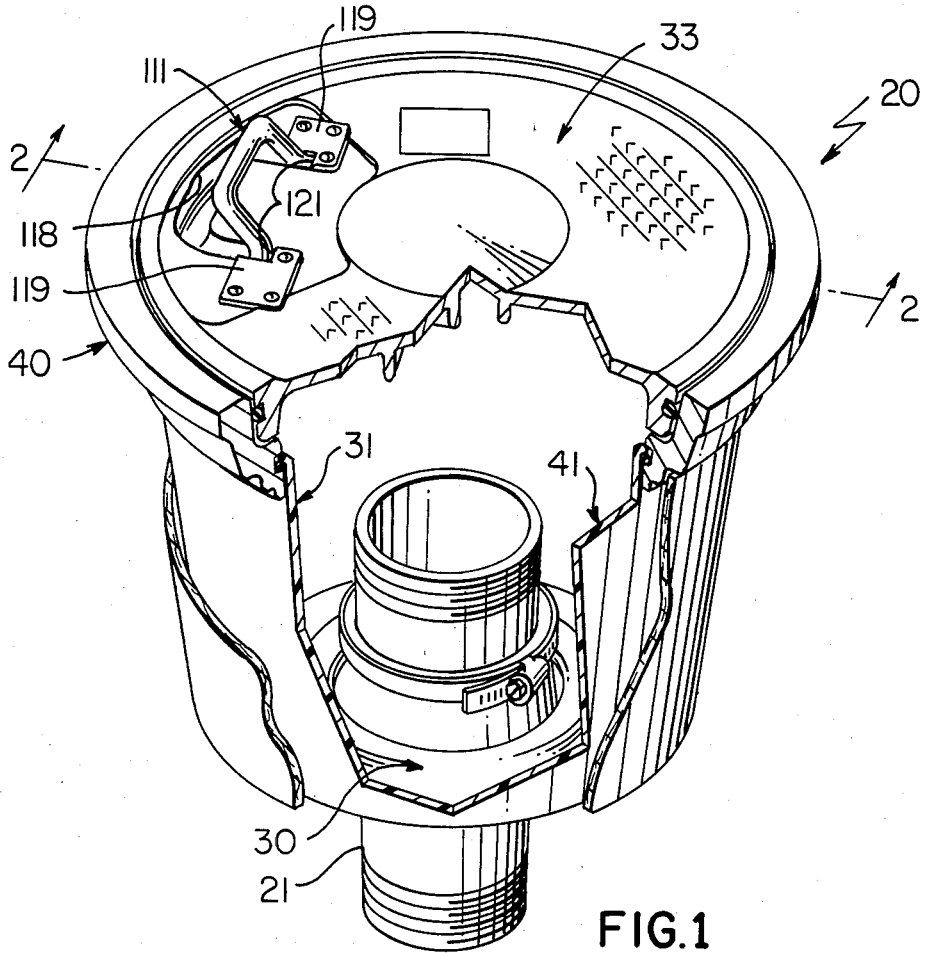
FIG. 1 is an isometric view with parts in cross section, parts in elevation, and parts broken away illustrating one exemplary embodiment of a spill container of this invention together with an associated vertical fill pipe and also illustrating a sleeve in position around a portion of the side wall of such container.
Figure 2:
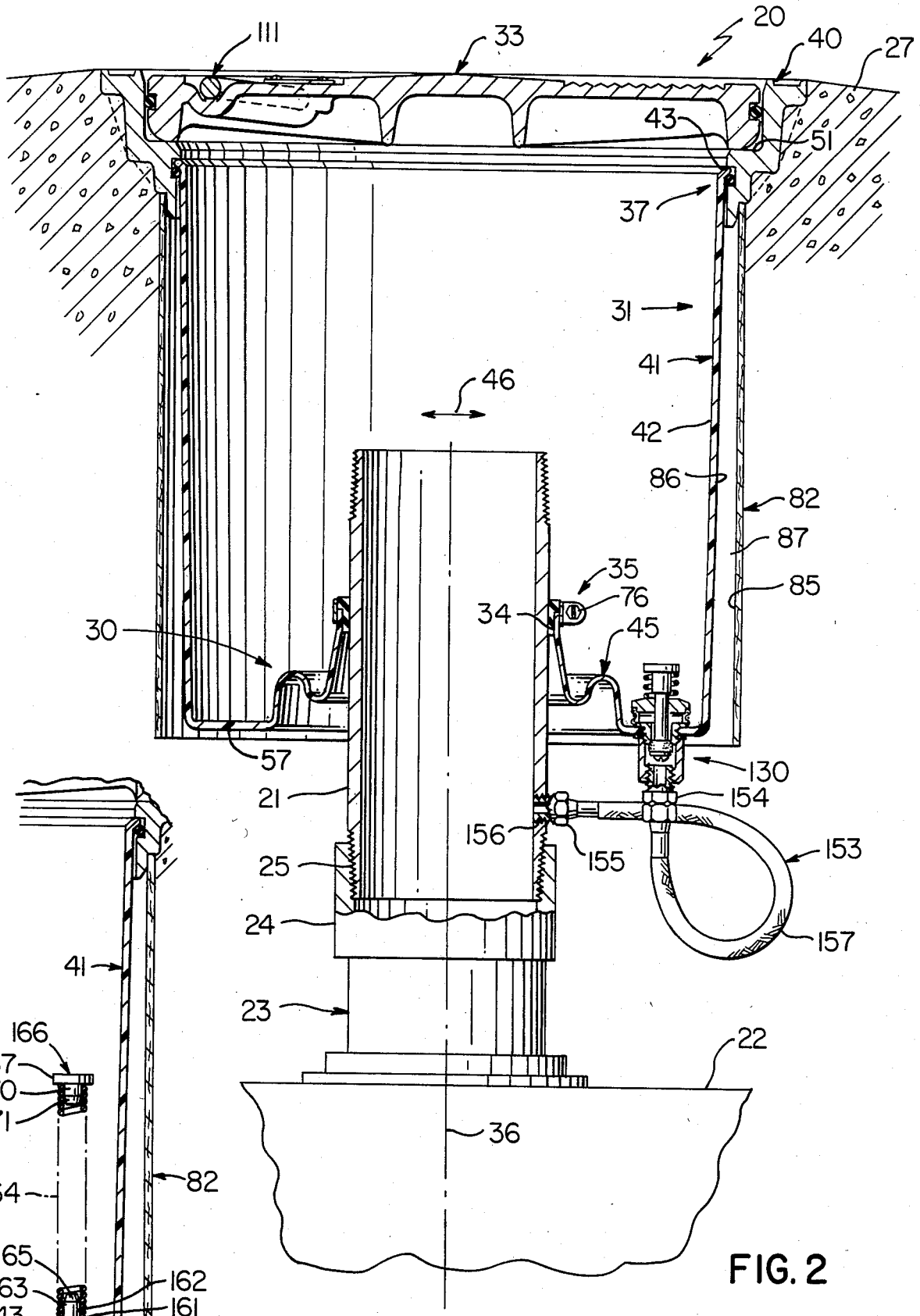
FIG. 2 is a cross-sectional view taken essentially on the line 2—2 of FIG. 1 and illustrating an upper ring portion of the side wall of the container embedded in a fixed manner in an associated substrate above an associated storage tank and also illustrating a drain valve provided in the bottom wall of such container.

Reference is now made to FIG. 1 of the drawings which illustrates one exemplary embodiment of a spill container of this invention which is designated generally by the reference numeral 20. The spill container 20 is particularly adapted for use at the inlet of a substantially vertical fill pipe 21 for an underground storage tank 22; and, such a storage tank is illustrated in FIG. 2 of the drawings. The storage tank 22 has an upwardly extending pipe assembly 23 which has its lower end suitably fixed to the tank 22 in sealed relation; and, the pipe assembly 23 has an internally threaded connector 24 at the upper end thereof which is particularly adapted to be threadedly engaged by external threads 25 at the lower end portion of the fill pipe 21.

The spill container 20 may have various applications; however, when the storage tank 22 is used to contain a petroleum product, or the like, the container 20 is designed to catch those small amounts of petroleum product that can be spilled upon disconnecting a delivery fitting normally used to deliver the petroleum product to the fill pipe 21. The spill container 20 thus helps prevent any petroleum product which is spilled, in the manner indicated, from entering a supporting substrate 27 for the container 20 in the area surrounding such container and fill pipe 21.

As seen in FIGS. 1 and 2 of the drawings the container 20 comprises a bottom wall which is designated generally by the reference numeral 30 and side wall means designated generally by the reference numeral 31 extending upwardly from the bottom wall and being adapted to be embedded in a fixed manner in the supporting substrate 27, shown as concrete 27, for the side wall means 31 and hence the container 20. The container 20 also comprises a cover which is designated generally by the reference numeral 33 and it will be seen that an opening 34 is provided in the bottom wall 30 for receiving the pipe 21 therethrough. Seal means designated generally by the reference numeral 35 provides a fluid seal, i.e., a fluid-tight seal, between the bottom wall 30 and the fill pipe 21 while allowing relative movement therebetween primarily along a vertical axis 36.

Figure 9:
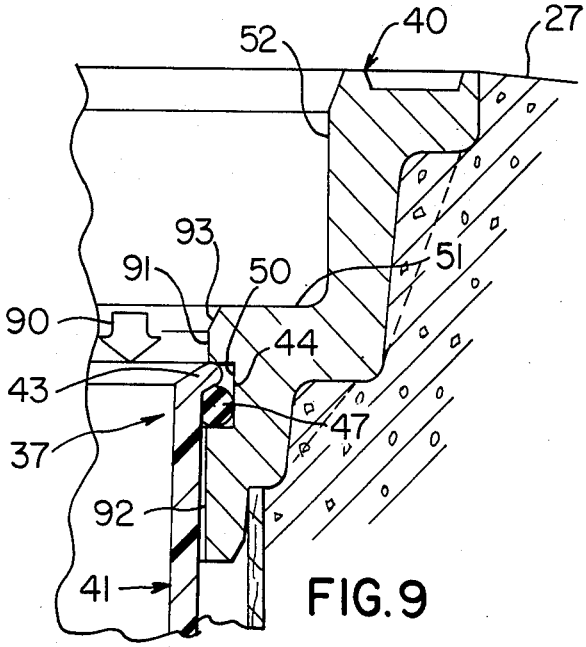
FIG. 9 is an enlarged view similar to FIG. 8 illustrating the vessel in the solid line position of FIG. 7.

In accordance with the teachings of this invention the side wall means 31 comprises at least two separate portions having means, designated generally by the reference numeral 37 in FIG. 9, detachably fastening such separate portions together. One of the portions consists of a ring 40 which will be described in more detail subsequently and such ring 40 is the sole means adapted to be embedded in a fixed manner in the substrate or concrete 27 to provide the sole support for the entire container 20 in the substrate and the other of the portions comprises a vessel which is designated generally by the reference numeral 41 and is detachable from the one portion or ring 40 with the ring 40 embedded in the substrate 27 through the use of the previously mentioned means 37 detachably fastening the portions 40 and 41 together to thereby enable replacement of portion 41, if desired.

Figure 7:
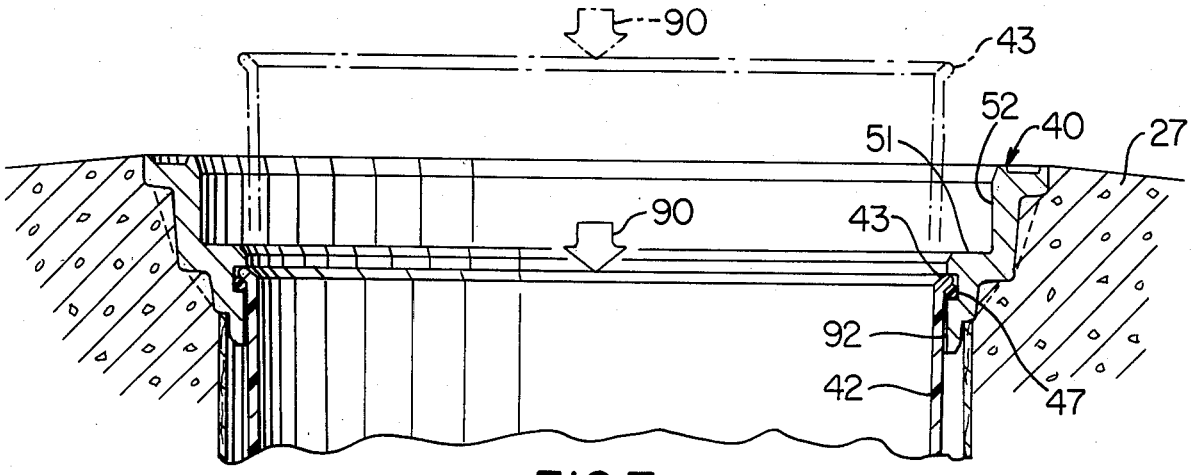
FIG. 7 is a view particularly illustrating the manner in which a vessel portion comprising the container of FIG. 1 moved from a dotted line position to a solid line position and snap-fitted with the above-mentioned ring portion embedded in its associated substrate.
Figure 8:
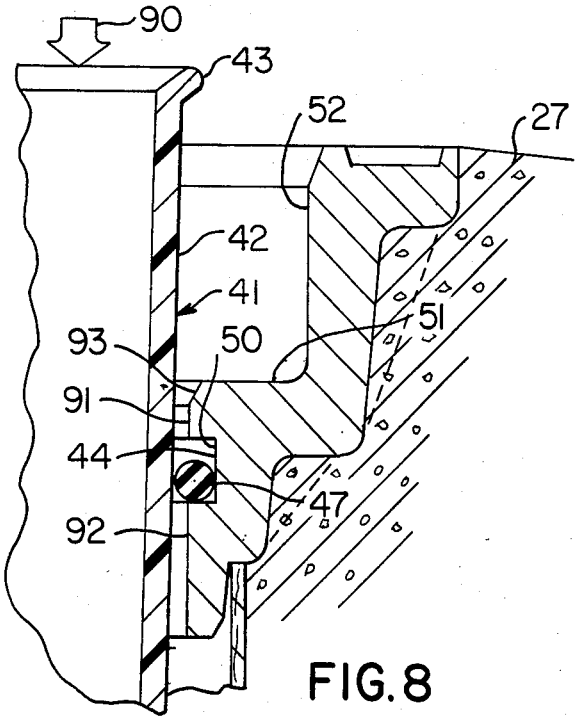
FIG. 8 is an enlarged cross-sectional view of a side portion of the vessel portion essentially as it would appear in solid lines at the location which corresponds roughly to the dotted line position of FIG. 7.

The ring 40 may be made of any suitable material but is preferably made of a suitable metal and the vessel 41 has a tubular wall 42 which terminates, at the top thereof, in a radially outwardly extending annular flange 43 (FIG. 8) which comprises the means 37 for detachably fastening the ring 40 and the vessel 41 together. The ring 40 also has an inwardly facing annular ring groove 44 which also comprises the means 37 detachably fastening the ring 40 and vessel 41 together. As seen in FIGS. 7, 8 and 9, the flange 43 is adapted to be snap-fitted into the ring groove 44 to provide a fluid-tight seal between the vessel 41 and ring 40.

Referring again to FIG. 2 of the drawings, it is seen that the vessel 41 has an integral bottom wall which comprises the bottom wall of the container 20 and is thus designated by the reference numeral 30. The bottom wall 30 has integral concentric flexible convolutions designated generally by the reference numeral 45, which will be described in more detail subsequently, and such convolutions 45 allow relative movements between the bottom wall 30 and fill pipe 21 along the vertical axis 36 due at least in part to the convolutions 45 themselves and such convolutions 45 also allow movements of the bottom wall 30 relative to the pipe 21 transverse the vertical axis 36.

The above described transverse movements are designated schematically by a double arrow 46 in FIG. 2 which is shown disposed perpendicular to the axis 36 in this illustration. However, it will be appreciated that the double arrow 46 is intended to indicate that such relative transverse movements could be in an infinite number of directions perpendicular to the axis 36, as well as directions other than perpendicular to such axis. It will be understood by those skilled in the art that relative movements between the bottom wall 30 and pipe 21 may be caused by shifting of the tank 22 and its pipe 21 due to upheaval of the ground in which the tank 22 is buried or due to movement of the concrete substrate 27 for any reason and which would cause movement of the container 20. The convoluted bottom wall 30 serves to accommodate a certain amount of such relative movements without breakage while maintaining the structural integrity of the container 20 and still keeping the fluid seals associated with such container 20 substantially intact and performing their intended functions.

As will be readily apparent from the drawings, the tubular wall 42, the annular flange 43, and bottom wall 30 of the vessel 41 are defined as a single-piece structure. The single-piece structure 41 will be described in more detail subsequently.

Referring to FIG. 9 of the drawings, it is seen that container 20 has a first O-ring seal 47 between the flange 43 and annular surface means 50 defining the ring groove 44. The annular surface means 50 comprises a plurality of cooperating surfaces which when viewed in cross section define a roughly U-shaped configuration and it will be seen that the O-ring 47 is in both radial and axial compression to thereby assure provision of a fluid-tight seal between the vessel 41 and the ring 40.

Figure 5:
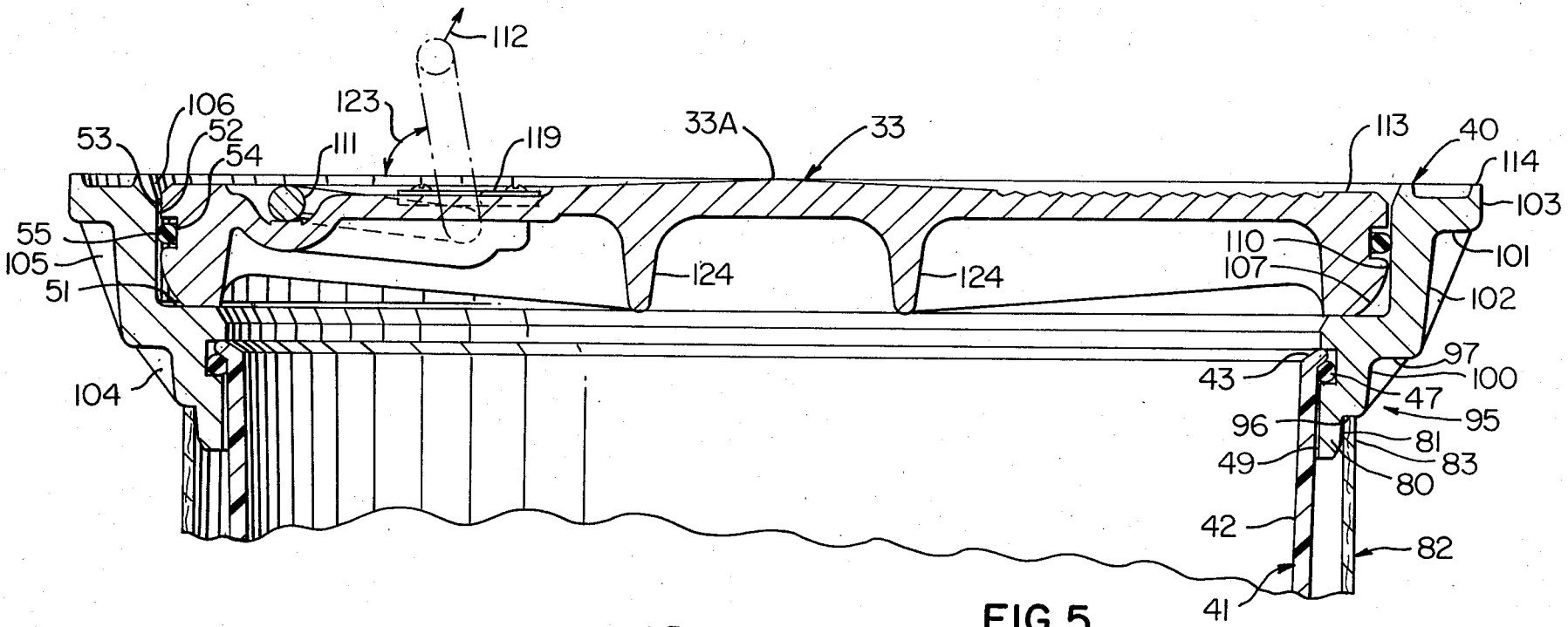
FIG. 5 is an enlarged fragmentary cross-sectional view of the upper portion of the container of FIG. 1.
Figure 6:
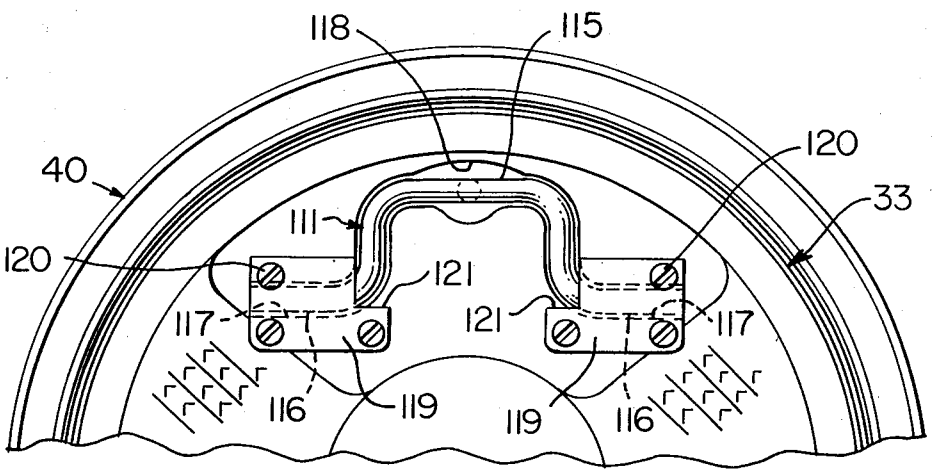
FIG. 6 is a fragmentary top view particularly illustrating the handle comprising the cover of the container of FIG. 1 in its normal dropped position.

Referring now to FIG. 5 of the drawings, it is seen that the ring 40 has an innermost substantially cylindrical surface 49 and an annular ledge 51 extending radially from the innermost cylindrical surface 49. The ring 40 also has second substantially cylindrical surface 52 which adjoins the periphery of the annular ledge 51 and the cover 33 is supported on the annular ledge 51.

The cover 33 has an outer surface 53 and a cover groove 54 extending radially inwardly from its outer surface 53. A second O-ring seal 55 is disposed in the cover groove 54 and acts between the cylindrical surface 52 of the ring 40 and the cover 33 to provide a fluid-tight seal therebetween. The O-ring seal 55 assures that fluid does not enter or exit the container 20.

Referring again to FIG. 2 of the drawings it is seen that the single-piece structure comprising the vessel 41 is cross-hatched as being made of a plastic material. Such structure is preferably made of a yieldable resilient polymeric material which enables the snap-fitting of the annular flange 43 in the ring groove 44. Although any suitable polymeric material may be used to make the vessel 41, a high density polyethylene is the preferred material.

The side wall 42 of the vessel 41 has a downwardly converging substantially frustoconical configuration as also seen in FIG. 2. This configuration facilitates detachment of the vessel 41 from the ring 40 with the ring embedded in the concrete substrate 27.

Figure 3:
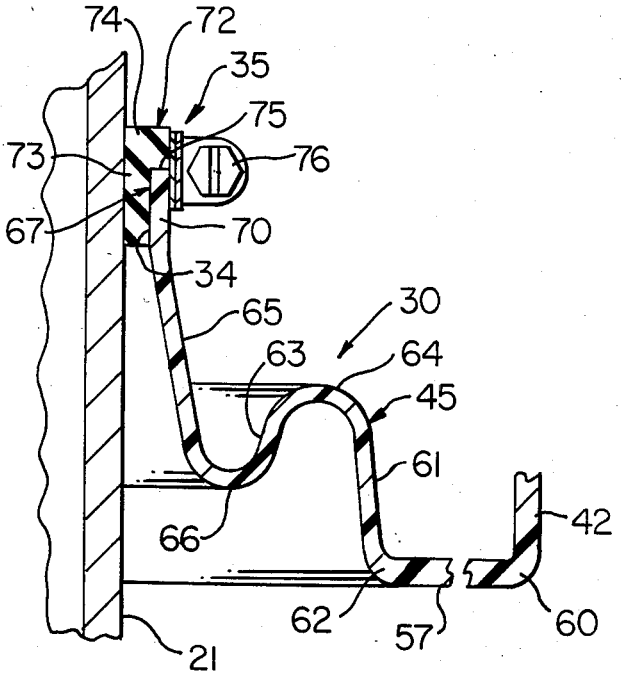
FIG. 3 is an enlarged fragmentary cross-sectional view illustrating a portion of the bottom wall of the container of FIG. 1 and a portion of seal means which provides a fluid seal between such bottom wall and its associated fill pipe.

The bottom wall 30 has convolutions 45 therein as previously defined. In particular, and as best seen in FIG. 3, the bottom wall comprises an annular planar portion 57 adjoining the bottom edge of the side wall 42 with a first arcuate transition 60 therebetween. The bottom wall 30 also comprises a first upwardly tapering frustoconical portion 61 adjoining the inner edge of the annular planar portion 57 with a second arcuate transition 62 therebetween. A downwardly tapering frustoconical portion 63 adjoins the top edge of the first upwardly extending tapering portion 61 with a third arcuate transition 64 therebetween. The downwardly tapering portion 63 has a height which is less than the height of the upwardly tapering portion 61 and in this example such height is about ½ the height of the portion 61. The bottom wall 30 also includes a second upwardly tapering portion 65 adjoining the bottom edge of the downwardly tapering portion 63 with a fourth arcuate transition 66 therebetween. The second upwardly tapering portion 65 terminates in surface means designated generally by the reference numeral 67 and which defines the opening 34 in the bottom wall 30. The arcuate transition portions 60 and 62 are of substantially equal radii. Similarly, arcuate transition portions 64 and 66 are of roughly equal radii; however, the radius of each arcuate portion 64 and 66 is several times greater than the radius of each arcuate portion 60 and 62.

As previously mentioned surface means 67 defines the opening 34 in the bottom wall 30. In this example of the invention the surface means 67 comprises a cylindrical wall portion 70 which blends smoothly with the top edge of the upwardly tapering frustoconical portion 65.

The container 20 also has the previously mentioned seal means 35 for providing a fluid seal between the bottom wall 30 and the fill pipe 21. The seal means 35 comprises an elastomeric seal member 72 which has a tubular portion 73 adapted to be disposed between the cylindrical wall portion 70 and the fill pipe 21. The seal member 72 also has a top portion 74 adjoining its tubular portion 73 and extending across a top annular edge 75 of the cylindrical wall portion 70. The seal means 35 also comprises a clamp device or clamp 76 for clamping the elastomeric seal member 72 against the fill pipe 21.

It will be appreciated that the construction and arrangement of the seal member 72 and clamp 76 of the seal means 35 provides a fluid-tight seal between the bottom wall 30 and the pipe 21 while also allowing some limited sliding movements of the pipe 21 relative to the bottom wall 30. Limited movements of the bottom wall 30 relative to the pipe 21 are also possible due to the convolutions 45 in the bottom wall 30 as previously described.

Referring again to FIG. 5 of the drawings it will be seen that the ring 40 has a lowermost portion 80 which has an outwardly facing substantially cylindrical surface 81. The container 20 also comprises a tubular sleeve 82 which has an upper end 83 fastened against the cylindrical surface 81 of the lowermost portion 80. The fastening action may be achieved by a press-fitting action or may be by the combination of a press-fitting and a suitable adhesive.

The tubular sleeve 82 may be made of any suitable material such as fiberboard, or the like, and such sleeve serves as a form member enabling only the ring 40 to be embedded in a fixed manner in the concrete substrate 27. As seen in FIG. 2 the thickness of the lowermost portion 80 is such that there is a tubular space between the inside surface 85 of the sleeve 82 and the outside surface 86 of the vessel 41 and such space is designated generally by the reference numeral 87. The space 87 increases in volume downwardly from the top of the vessel 41 to the bottom thereof due to the converging nature of the side wall 42 of vessel 41. The sleeve 82 serves to isolate the vessel 41 from the surrounding ground upon initial installation of the container.

The construction of the container 20 is such that the vessel 41 thereof may be removed and replaced in the field, if desired. This is achieved by disconnecting the clamp 76 from around the pipe 21 and proceeding in the manner to be described subsequently. Basically, such field installation first requires removal or withdrawal of the flange 43 from within its groove 44. Once the flange is thus withdrawn the vessel 41 may be readily extracted from its underground location and a new vessel 41 may be inserted and snap-fitted into position. It will be appreciated that the above removal and installation is with the ring 40 embedded in the concrete substrate 27. The installation of the vessel 41 is shown by the force arrows 90 in FIGS. 7, 8 and 9, whereby once the flange 43 is moved so that it clears the top portion 91 of an innermost annular cylindrical surface 92 of the ring 40 the flange 43 snaps into the groove 44 providing axial and radial compression of the O-ring seal 47 in the manner previously described.

It will be appreciated that prior to inserting a new vessel 41 into position a new seal 47 may be readily installed in position by placing same in the ring groove 44 after removal of the old seal. Further, the cylindrical surface 92 may have a tapered or frustoconical inlet surface 93 which serves as a cam surface to facilitate movement of the flange 43 during application of force 90. The cam surface 93 together with the yieldable resilient character of the vessel 41 and the flange 43 thereof facilitates snap-fitting of the flange 43 in the ring groove 44 and in sealed relation against the O-ring seal 47.

Referring again to FIG. 5 of the drawings it is seen that the ring 40 has inverted radial step means designated generally by the reference numeral 95. The radial step means 95 extend from the lowermost portion 80 of the ring 40 and such step means are adapted to provide a greater surface area during embedment of the ring 40 in the concrete 27. The step means 95 comprise a plurality of inverted downwardly facing steps in the form of a step 96 extending radially from the outside surface 81, a step 97 extending radially from a cylindrical surface 100 which extends vertically from the step 96, and a step 101 extending radially from a vertical cylindrical surface 102 which extends from the outer edge of step 97. The ring 40 terminates in a peripheral cylindrical surface 103.

The ring 40 also has web means comprising a plurality of webs 104 and a plurality of webs 105. The webs 104 extend between surface 100 and step 97 and the webs 105 extend between surface 102 and step 101. Any desired number of webs 104 and 105 may be provided and in this example the plurality of webs 104 and 105 are provided in equally angularly spaced relation with six (6) of each of such webs being provided.

It will also be seen in FIG. 5 that the ring 40 has a top frustoconical surface 106 which adjoins the top edge of the cylindrical surface 52. The top frustoconical surface 106 provides a shoehorn effect for the cover 33 and its O-ring seal 55 to enable installing the cover in position in a fluid-tight manner and without the likelihood of damage to the seal 55 and/or cover 33.

As previously mentioned the cover 33 has an outer cylindrical surface 53. The surface 53 has an arcuate annular portion 107 defining the bottom portion thereof and such arcuate portion 107 is of a comparatively large radius. The cover 33 also has an arcuate annular portion 110 in surface means defining the lower portion of the groove 54. The arcuate annular surface portions 107 and 110 allow the cover 33 to, in essence, roll out once a handle 111 comprising such cover is lifted outwardly as shown by the arrow 112. It would be appreciated that if the annular surface portions 107 and 110 were absent there would be a tendency to have a vacuum in the container 20 which would prevent easy removal of the cover 33.

The cover 33 may be made of any suitable material and preferably it is made of a cast metallic material preferably cast aluminum, due to the strength and light weight of aluminum. As also seen in FIG. 5, the cover 33 has what might be considered an upwardly convex configuration with the highest point or portion of such cover being at the center of such cover and designated 33A . The container 20 and in particular ring 40 thereof is installed or embedded in position so that portion 114 is at grade level. The configuration of the cover 33 is such that a top peripheral surface 113 thereof is below grade level. This configuration assures that a snow plow or the like may be moved across the cover without catching an edge thereof.

The handle 111 has a substantially U-shaped central portion 115 with rectilinearly aligned extensions 116 at the opposite ends thereof. The handle 111 is supported in the cover so that its extensions 116 are disposed in suitable recesses 117 in the cover and its central portion 115 is disposed in a configurated recess 118 in the cover. A pair of plates 119 are fastened in position over extensions 116 by threaded screws 120 to hold the handle on the cover while allowing free pivoting of such handle so that portion 115 moves freely into and out of recess 118.

The plates 119 have side edge portions 121 defined by cutouts in the inner portions of such plates and the edges 121 are constructed, arranged, and configured to cooperate with the configuration of the handle 111 so that the handle, when lifted, is in a position which is less than vertical from a horizontal plane. When lifted, the handle is preferably at an approximately 80° angle as shown at 123 in FIG. 5, whereby once the handle is released it is free falling and will fall in position as portion 115 falls by gravity within its associated cutout 118 where it is protected against engagement and lifting by a snow plow.

The cover has reinforcing means in the form of reinforcing webs 124 defining the inside surface thereof. The webs 124 give the cover 33 added strength and structural integrity.

Figure 4:
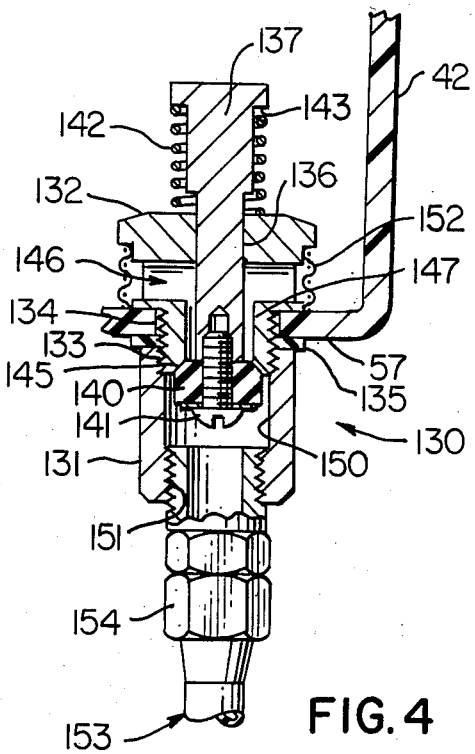
FIG. 4 is an enlarged view with parts in elevation, parts in cross section, and parts broken away particularly illustrating the drain valve in the bottom wall of the container.

The container 20 may be provided with a suitable valve assembly 130 which is preferably mounted in the bottom wall 30 thereof and as shown in FIG. 2. The valve assembly 130 is shown in FIG. 4 in its normally closed position; and, such valve assembly is in flow communication between the interior and exterior of the container 20 and is provided for emptying liquid spilled into the container 20.

The valve assembly 130 is preferably mounted in the annular planar portion 57 of the bottom wall 30 which adjoins the bottom edge of the side wall 42 and which defines the lowermost liquid confining wall of the container 20. With this placement of the valve assembly 130, substantially all of any liquid spilled into the container 20 may be drained through such valve assembly 130.

The valve assembly 130 comprises a lower body 131, an upper body 132, and means in the form of cooperating threaded portions shown at 133 fastening the upper and lower body together with a portion (annular portion 57) of the bottom wall 30 sandwiched therebetween in a fluid-tight manner. In this example a lower threaded portion of the upper body 132 is extended through an aperture 134 in the annular planar portion 57 of bottom wall 30 and a sealing gasket 135 is provided between the lower valve body portion 131 and the bottom wall 30 before threading portions 131 and 132 together.

The valve assembly 130 has fluid passage means therethrough, which will be described in more detail subsequently, terminating in a valve outlet 151; and, a plunger assembly comprised of a spring-loaded plunger 137 and a closure member 140 made of a suitable polymeric material (such as rubber, or the like) for controlling fluid flow through the passage means. The upper body portion 132 has a bore 136 which slideably receives the spring-loaded plunger 137 for vertical sliding movement therethrough; and, the closure member 140 is in the form of a plug-like member which is fastened in position by a threaded screw 141 which is threaded into a threaded opening in the lower portion of the plunger 137. The valve assembly 130 is held normally closed by a compression spring 142 which acts between the top surface of the member 132 and an annular shoulder 143 at the top of the plunger 137 to hold the closure member 140 sealed against an annular frusto-conical sealing surface 145 provided at the lower end of member 132. The valve assembly 130 is opened by overriding the compression spring 142.

As previously mentioned the valve assembly has fluid passage means therethrough which will now be described. In particular, the member 132 has a passage which may be in the form of a diametrically extending passage 146 extending through the member 132 and communicating with a central axial bore 147 in the lower end of the member 132. The bore 147 terminates in the frustoconical seating surface 145 and in turn communicates with a central axial bore 150 in the lower member 131 which communicates with an internally threaded outlet passage 151 which defines the previously mentioned outlet 151 of the valve 130. The valve 130 has a screen 152 which is provided to prevent impurities from entering into the passage 146. Thus, fluid passage means through the valve assembly is comprised of passage 146, bore 147, bore 150, and threaded outlet passage 151.

During normal operation of the valve 130 the spring 142 holds the closure member 140 against frustoconical surface 145 and thereby holds the valve assembly 130 closed, thereby preventing fluid flow therethrough. The valve assembly is opened by overriding the compression spring 142. It is a simple matter to override such spring 142 by pushing downwardly on the member 137 and thereby move the closure member 140 away from the frustoconical surface 145.

The valve 130 has a flexible conduit assembly, which is designated generally by the reference numeral 153, associated therewith; and, such assembly 153 is in flow communication between the valve outlet 151 and the fill pipe 21. The conduit assembly 153 (FIG. 2) has a suitable swivel fitting 154 at one end threadedly fastened to the threaded outlet 151 and a swivel fitting 155 at its opposite end threadedly fastened within an internally threaded opening 156 in the fill pipe 21. The conduit assembly 153 has a loop 157 provided therein and such loop allows relative motion between the container 20 and the pipe 21 without imposing stresses on either of these components. In those applications where the container 20 is used and where it is desired to use a valve assembly 130 in association with the container 20, the associated fill pipe 21 is preferably provided with a threaded opening 156 having a threaded plug (not shown) therein. Such plug is, of course, removed to receive the swivel connector 155 of the conduit assembly 153.

Figure 10:
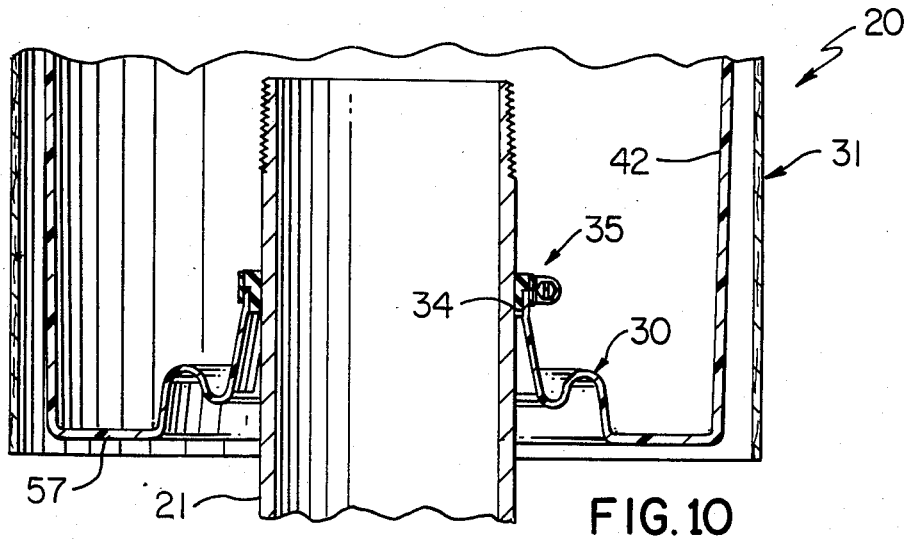
FIG. 10 is a view particularly illustrating a modification of the container which is not provided with a drain valve in the bottom wall thereof.

It will be appreciated that in some applications of this invention it may not be necessary or desired to utilize a valve assembly 130. For these applications a container identical to the container 20 described herein but minus the valve assembly 130 may be provided. The lower portion of such a container is illustrated in FIG. 10 of the drawings and is also designated by the reference numeral 20. All parts of the container 20 of FIG. 10 are identical with the corresponding parts of the container 20 previously described in connection with FIGS. 1–9 whereby such description will not be repeated. As indicated above, the only difference in the container 20 of FIG. 10 and in the container 20 previously described is the absence, in the container of FIG. 10, of the valve assembly 130. The container 20 of FIG. 10 may be emptied using any suitable means known in the art such as a siphon apparatus, or the like.

In addition to the container 20 and method of making same described herein; this invention provides a new method of installing a liquid spill container 20 at the inlet of a substantially vertical fill pipe 21 for a storage tank 22 wherein the container 20 comprises, bottom wall 30 and side wall means 31 extending upwardly from the bottom wall, with the bottom wall 30 having an opening 34 for receiving the fill pipe 21 therethrough, the method comprising the step of embedding the side wall means 31 in a fixed manner in the supporting substrate 27 for the side wall means 31 and container 20, and providing seal means 35 adapted to provide a fluid seal between the bottom wall 30 and fill pipe 21 while allowing relative movement therebetween along a vertical axis. In accordance with this invention, the step of embedding the side wall means 31 comprises the step of providing the side wall means comprised of at least two separate portions and providing means 37 detachably fastening the said portions together. The method of installing comprises the step of detachably fastening said portions together employing the means 37 detachably fastening and embedding only one of the said portions in said fixed manner in the substrate 27 to provide the sole support for said container in the substrate with the other portion being free of embedment in said fixed manner. Accordingly, the other portion is detachable from the said one portion with the one portion embedded in the substrate 27 through the use of the means 37 detachably fastening to enable replacement of the said other portion.

In accordance with this invention the one portion of the side wall means 31 comprises the ring 40 so that the step of embedding only the one portion comprises embedding only the ring 40. The other portion of the side wall means 31 comprises a vessel 41 having a tubular wall 42 which terminates in the upper annular flange 43. The annular flange 43 comprises the means 37 detachably fastening the portions (ring 40 and vessel 41) together.

As described above, the ring 40 has a lowermost portion 80 which has an outwardly facing sleeve-engaging cylindrical surface 81 and the method of installing further comprises the step of providing the tubular sleeve 82 which has upper end 83 and fastening the upper end 83 against the sleeve-engaging surface 81. Accordingly, the sleeve 82 serves as a form member enabling only the ring 40 to be embedded in the above-mentioned fixed manner in the concrete substrate 27.

As also described above the ring 40 has the inwardly facing annular ring groove 44 which also comprises the means 37 detachably fastening. The annular flange 43 is adapted to be snap-fitted in the ring groove 44 to provide a fluid-tight seal between the vessel 41 and the ring 40 yet allowing replacement of the vessel 41 with the ring embedded in the substrate 27.

As explained earlier, the bottom wall 30 has integral flexible convolutions 45 which allow relative movement between the bottom wall 30 and fill pipe 21 along the vertical axis 36 due at least in part to flexing movements of the convolutions 45. As also mentioned earlier the convolutions 45 also enable movements of the bottom wall 30 relative to the pipe 21 transverse the vertical axis 36 upon relative movement of the fill pipe 21 through opening 34 in said bottom wall 30 after or during embedding of only the ring 40 with the vessel 41 detachably fastened to the ring 40. It will be appreciated that the flexible convolutions 45 accommodate substantial misalignments of the container 20 relative to the fill pipe 21.

It is again emphasized that a very practical feature of this invention is the comparative ease with which the vessel 41 may be replaced with the ring 40 embedded in the substrate 27. This is achieved by withdrawing the annular flange 43 of the vessel 41 from within the ring groove 44 as mentioned earlier. The vessel is then extracted outwardly through the ring 40 whereupon an identical vessel 41 is installed in position to complete the container 20 by snapfitting an annular flange 43 of the identical vessel 41 into the ring groove 44 after a new 'O' ring 47 has been installed in position in groove 44.

In some instances the above described step of replacing the vessel 41 may comprise the step (not shown) of piercing holes in the tubular wall of the vessel 41 being replaced to enable insertion of suitable tool means (also not shown) therein to facilitate withdrawal of its annular flange 43 from the ring groove 44 prior to the extracting of the vessel 41 being replaced.

In other instances the step of replacing the vessel 41 comprises prying the annular flange 43 inwardly from the top surface of the groove 44 with a screwdriver shank a sufficient amount to expose a part of the 'O' ring 47. Another screwdriver shank is then positioned under the exposed part of the 'O' ring 47 whereupon such 'O' ring is pried outwardly and pulled away from within its groove with a peeling motion. A sharp cutting means (e.g., a chisel and hammer) is then used to cut vertically through the flange 43 and tubular wall 42 toward the bottom wall 30 a substantial distance, generally of the order of eight to ten inches. The clamp 76 is then loosened and the wall portion 70 is pulled away from the seal member 72. The cut portion of the upper part of vessel 41 is then collapsed inwardly and comparatively easily extracted upwardly through the ring 40. A replacement 'O' ring 47 and vessel 41 are then installed in position as previously described.

Thus, it is seen that the container 20 has optimum versatility. In particular, such container is installed in position in a new installation by embedding only the ring 40 thereof in a concrete substrate 27, or the like, while isolating the remaining vessel portion 41 thereof utilizing the tubular sleeve 82 which serves as a concrete form. Ordinarily, the concrete substrate 27 is only poured in a predetermined thickness which is substantially less than the height of the sleeve 82 whereby only the top part of the sleeve 82 serves as a concrete form and the lower part of the sleeve keeps ground fill away from the container receptacle 41. As described above, it is a simple matter to replace the vessel 41 of the container 20 at any time. This replacement may be achieved without the need or expense of tearing out the entire container 20 and with no damage to the concrete substrate 27.

The container 20 of this invention also lends itself for use as a replacement container for other types of existing embedded containers which do not have the features of the container 20. In particular, it is entirely practical to cut away a rectangular block of concrete substrate which has an existing container in the central portion thereof using a concrete saw, or the like. The container 20 of this invention may then be supported in position with its sleeve 82 serving to isolate the receptacle 41 while embedding the ring 40 in a new rectangular concrete block which is sealed from the remaining concrete. Once this latter type of installation has been achieved the container of this invention may have the receptacle portion 41 readily removed and a new one installed, as described earlier, whereby the container 20 of this invention is capable of providing an extended service life even in this replacement type of application.

It is again emphasized that the convolutions in the bottom wall 30 enable greater relative movement and greater misalignment of the container 20 of this invention with respect to a fill pipe 21. This feature makes possible installation of the container 20 not only in a new application but also in an application where the container 20 is used to replace an existing container at a minimum cost.

The ring 40 of this invention may be made of any suitable metallic high strength material; however, such ring is preferably made by casting of a cast iron material. It will also be appreciated that the various surfaces of the ring 40 and in particular all machined surfaces thereof are preferably coated with a suitable coating material at thicknesses generally ranging between 0.001 and 0.002 inch. A suitable coating material which may be employed is, polytetrafluoraethylene (PTFE).

In this disclosure of the invention the cover 33 has been described as being made of cast aluminum alloy; and, such a cast aluminum cover has optimum desirability inasmuch as it is light weight and easy to lift using handle 111. However, it will be appreciated that the cover may be made of cast iron or non-metallic materials, if desired. In any event, the cover whether made of aluminum, cast iron, or non-metallic materials preferably has a corrugated top surface defining an antiskid surface. Further, when the cover is made of aluminum alloy it is preferably coated using an electrodeposition process to deposit an epoxy resin coating thereon. When the cover is a cast iron cover it is preferably coated using an acid zinc coating.

In this disclosure of the invention the fill pipe 21 is provided with an externally threaded top portion and it is to be understood (as is known in the art) that such externally threaded top portion may be provided with a suitable closure valve, if desired.

Figure 2A:
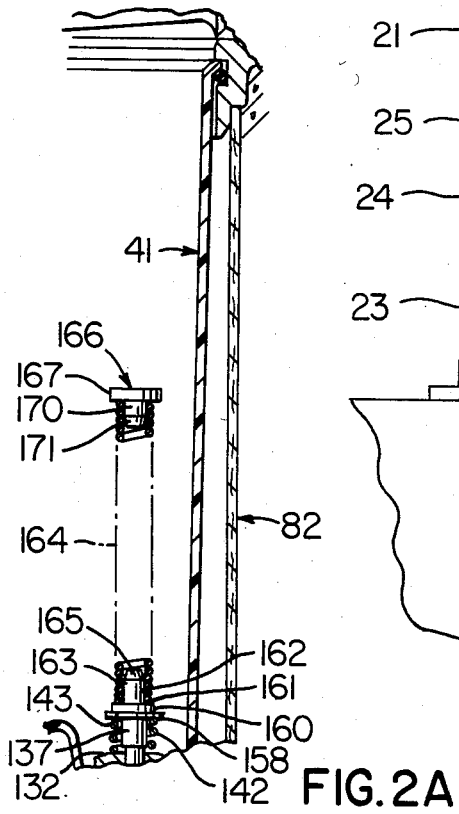
FIG. 2A is a fragmentary view similar to the right hand portion of FIG. 2 illustrating a modification of the drain valve which has an extension provided thereon for ease of actuation.

Reference is now made to FIG. 2A of the drawings which illustrates a modification of the container 20. The modified container of FIG. 2A is substantially identical to the container 20 previously described with the exception of the drain valve assembly mounted in its bottom wall which in the FIG. 2A modification has means enabling easier opening of such valve assembly. Except for such means enabling easier opening, the valve assembly of FIG. 2A is also substantially identical to the valve assembly 130 previously described and representative similar parts will be designated by the same reference numerals as previously and not described again. Only those parts which are different or newly added will each be designated by a new reference numeral in FIG. 2A and described in detail.

Accordingly, the valve assembly of FIG. 2A has upper body 132 and spring-loaded plunger 137 which has an integral annular projection 160 and an elongated stem portion or stem 162 disposed outwardly of the projection 160. The stem 162 has an outside diameter 163 and a frustoconical taper 165 at its outer end.

The annular projection 160 on the plunger 137 has an annular shoulder 143 defining one surface thereof and such shoulder is adapted to receive thereagainst a washer 158 which comprises the valve assembly. The compression spring 142 used to hold the valve closure member closed acts between the upper body 132 and the shoulder 143, transmitting force through washer 158. It will be appreciated that the washer may be eliminated, if desired.

The means enabling easier opening of the valve assembly comprises an extension which in this example is in the form of a closely wound elongated spring 164 made of music wire or the like. The spring 164 has an inside diameter which is sized to be received around and against the outside diameter 163 so that the spring is held on the stem 162 by friction. The bottom of the spring abuts against a top annular surface 161 of the projection 160 enabling the plunger to be moved axially to open the valve assembly upon applying opening forces at the top of the spring 164. The spring 164 is also easily installed on the stem through the use of the frustoconical taper 165.

Although opening forces could be applied by pushing directly against the top of the spring 164 to open the valve assembly, a plastic opening button 166 is preferably provided and attached at the top of such spring. The button 166 has a disc-like top portion 167 adjoined by an integral cylindrical portion 170 of smaller diameter than portion 167. Portion 170 terminates in a frustoconical taper 171 which is provided to facilitate insertion of portion 170 into the top end portion of the spring 164. The outside diameter of portion 170 and the inside diameter of the spring are such that portion 170, and hence button 166, are held firmly in position by friction.

With the extension spring 164 installed on the stem 161 the valve assembly is opened as described before by pushing downwardly on the member 137 to override spring 142 and thereby open the drain valve. The extension spring 164 and button 166 enable opening forces to be applied without reaching very far into the spill container 20 once the cover 33 is removed.

In this disclosure of the invention, use has been made of terms such as upper, lower, inner, outer, top, bottom, and the like. However, it is to be understood that these terms are used to describe various components and portions as illustrated in the drawings and such terms should not be considered limiting in any way.

The container 20 has been described herein as being useable in association with a storage tank for a petroleum product; however, it is to be understood that the container 20 may be used in association with a tank or other receptacle containing other liquid products. It will also be appreciated that in addition to using the container 20 of this invention in the manner described herein it may be used in connection with vapor recovery systems, or the like, to provide some containment in a similar manner as described herein.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a liquid spill container for use at the inlet of a substantially vertical fill pipe for a storage tank, said container comprising a bottom wall, side wall means extending upwardly from said bottom wall and having at least one portion of said side wall means for being embedded in a fixed manner in a supporting substrate for said side wall means and container, a cover for said container, an opening in said bottom wall for receiving said fill pipe therethrough, and seal means providing a fluid seal between said bottom wall and fill pipe while allowing relative movement therebetween along a vertical axis, the improvement in which said side wall means comprises at least two separate portions having preformed means detachably fastening said portions together in a snap-fitted manner while maintaining said means detachably fastening intact and free of permanent deformation, said one of said portions being the sole means for being embedded in said fixed manner in said substrate to provide the sole support for said container in said substrate and the other of said portions being detachable from said one portion solely by relative axial movement between said portions with said one portion embedded in said substrate through the use of said means detachably fastening to enable replacement of said other portion.

2. A container as set forth in claim 1 in which said one portion comprises a ring and said other portion comprises a vessel having a tubular wall which terminates in an upper annular flange, said annular flange comprising said means detachably fastening said portions together.

3. A container as set forth in claim 2 in which said ring has an inwardly facing annular ring groove which also comprises said means detachably fastening, said annular flange being adapted to be fastened in said ring groove in said snap-fitted manner to provide a fluid-tight seal between said vessel and ring.

4. A container as set forth in claim 3 in which said vessel has a bottom wall which comprises said bottom wall of said container.

5. A container as set forth in claim 4 in which said bottom wall has integral flexible convolutions which allow said movement along said vertical axis due at least in part to flexing movements of said convolutions, and said convolutions also allow movements of said bottom wall relative to said pipe transverse said vertical axis.

6. A container as set forth in claim 5 in which said vessel tubular wall including said annular flange thereof and said bottom wall of said vessel are defined as a single-piece structure.

7. A container as set forth in claim 5 and further comprising a first O-ring seal between said flange and annular surface means defining said ring groove, said first O-ring seal being in both axial and radial compression to thereby assure provision of said fluid-tight seal.

8. A container as set forth in claim 7 in which said ring has an innermost substantially cylindrical surface, an annular ledge extending radially from said innermost surface, and a second substantially cylindrical surface adjoining the periphery of said annular ledge, said cover being supported on said annular ledge.

9. A container as set forth in claim 7 in which said cover has an outer surface and a cover groove extending radially inwardly from said outer surface, and further comprising a second O-ring seal disposed in said cover groove and acting between said second cylindrical surface of said ring and cover to provide a fluid-tight seal therebetween and assure fluid does not enter or exit said container.

10. A container as set forth in claim 4 in which said ring has an innermost substantially cylindrical surface, an annular ledge extending radially from said innermost surface, a second substantially cylindrical surface adjoining the periphery of said annular ledge, said cover being supported on said annular ledge, said cover having an outer surface, a cover groove extending radially inwardly from said outer surface, and further comprising a cover O-ring seal disposed in said cover groove and acting between said second cylindrical surface of said ring and cover to provide a fluid-tight seal therebetween and assure fluid does not enter or exit said container.

11. A container as set forth in claim 6 in which said single-piece structure is made primarily of a yieldable resilient polymeric material which enables said snap-fitting of said annular flange in said ring groove.

12. A container as set forth in claim 11 in which said polymeric material is high density polyethylene.

13. A container as set forth in claim 11 in which said side wall has a downwardly converging substantially frustoconical configuration which facilitates detachment of said vessel from said ring with said ring embedded in said substrate.

14. A container as set forth in claim 4 in which said ring has a lowermost portion which has an outwardly facing substantially cylindrical surface and further comprising a tubular sleeve having an upper end fastened against said cylindrical surface of said lowermost portion, said sleeve serving as a form member enabling only said ring to be embedded in said fixed manner in said substrate while also serving as a protective sleeve during shipment of said container.

15. A container as set forth in claim 14 in which said tubular sleeve is made of a fibrous nonmetallic material.

16. A container as set forth in claim 14 in which said ring has radial step means extending from said lowermost portion, said step means being adapted to provide a greater surface area during embedment of said ring in said substrate.

17. A container as set forth in claim 16 in which said step means comprises a plurality of inverted downwardly facing steps and further comprising web means between associated steps, said web means providing increased strength for said ring and more surface area during said embedment.

18. A container as set forth in claim 10 in which said ring has a top frustoconical inside surface adjoining the top edge of said second cylindrical surface, said top frustoconical surface providing a shoehorn effect for said cover and its cover O-ring seal.

19. A container as set forth in claim 5 and further comprising a valve assembly in flow communication between the interior and exterior of said container, said valve assembly enabling emptying of liquid spilled into said container.

20. A container as set forth in claim 19 in which said valve assembly is mounted in said bottom wall and has means enabling easier opening thereof upon reaching downwardly through the top open end of said container.

21. A container as set forth in claim 1 and further comprising a valve assembly in flow communication between the interior and exterior of said container, said valve assembly being mounted in a lowermost portion of said bottom wall of said container, said valve assembly enabling emptying of liquid spilled into said container.

22. A container as set forth in claim 21 in which said valve assembly comprises a normally closed valve assembly comprising an upper body, a lower body, means fastening said upper and lower body together with a portion of said bottom wall sandwiched therebetween in a fluid-tight manner, fluid passage means through said valve assembly terminating in a valve outlet, and a plunger assembly for controlling fluid flow through said passage means.

23. A container as set forth in claim 22 in which, said plunger assembly is held normally closed by a compression spring, said valve assembly is opened by overriding said compression spring, and further comprising an extension detachably fastened to said plunger assembly and extending uowardly away from said bottom wall, said extension enabling easier opening of said valve assembly upon reaching downwardly through the top open end of said container.

24. A container as set forth in claim 23 and further comprising a flexible conduit assembly in flow communication between said valve outlet and said fill pipe.

25. In a liquid spill container adapted for use at the inlet of a substantially vertical fill pipe for a storage tank, said container comprising a bottom wall, side wall means extending upwardly from said bottom wall and having at least one portion of said side wall means for being embedded in a fixed manner in a supporting substrate for said side wall means and container, a cover for said container, an opening in said bottom wall for receiving said fill pipe therethrough, and seal means providing a fluid seal between said bottom wall and fill pipe while allowing relative movement therebetween along a vertical axis, the improvement in which said side wall means comprises at least two separate portions having means detachably fastening said portions together, said one of said portions being the sole means for being embedded in said fixed manner in said substrate to provide the sole support for said container in said substrate and the other of said portions being detachable from said one portion with said one portion embedded in said substrate through the use of said means detachably fastening to enable replacement of said other portion, said one portion comprising a ring and said other portion comprising a vessel having a tubular wall which terminates in an upper annular flange, said annular flange comprising said means detachably fastening said portions together, said ring having an inwardly facing annular ring groove which also comprises said means detachably fastening, said annular flange being adapted to be snap-fitted in said ring groove to provide a fluid-tight seal between said vessel and ring, said vessel having a bottom wall which comprises said bottom wall of said container, said bottom wall having integral flexible convolutions which allow said movement along said vertical axis due at least in part to flexing movements of said convolutions with said convolutions also allowing movements of said bottom wall relative to said pipe transverse said vertical axis, said vessel tubular wall including said annular flange thereof and said bottom wall of said vessel being defined as a single-piece structure, said single-piece structure being made primarily of a yieldable resilient polymeric material which enables said snap-fitting of said annular flange in said ring groove, said side wall having a downwardly converging substantially frustoconical configuration which facilitates detachment of said vessel from said ring with said ring embedded in said substrate, said bottom wall comprising an annular planar portion adjoining the bottom edge of said side wall with a first arcuate transition portion therebetween, a first upwardly tapering frustoconical portion adjoining the inner edge of said annular planar portion with a second arcuate transition portion therebetween, a downwardly tapering frustoconical portion adjoining the top edge of said first upwardly tapering portion with a third arcuate transition portion therebetween, said downwardly tapering portion having a height which is less than the height of said upwardly tapering portion, a second upwardly tapering frustoconical portion adjoining the bottom edge of said downwardly tapering portion with a fourth arcuate transition portion therebetween, said second upwardly tapering portion terminating in surface means defining said opening in said bottom wall.

26. A container as set forth in claim 25 in which said surface means defining said opening in said bottom wall is a cylindrical wall portion blending smoothly with the top edge of said second upwardly tapering portion, said seal means providing a fluid seal between said bottom wall and fill pipe comprises an elastomeric seal member having a tubular portion adapted to be disposed between said cylindrical portion and said fill pipe, said elastomeric seal member having a top portion adjoining its tubular portion and extending across a top annular edge of said cylindrical wall portion, and a clamp device for clamping said elastomeric seal member against said fill pipe.

* * * * *